US005729805A

United States Patent [19]

Chiba et al.

[11] Patent Number: 5,729,805

[45] Date of Patent: Mar. 17, 1998

[54] IMAGE DEVELOPING METHOD USING SPECIFIC TYPE TONER AND DEVELOPING SLEEVE ROUGHNESS

[75] Inventors: Tatsuhiko Chiba, Kamakura; Masuo Yamazaki, Yokohama, both of Japan

[73] Assignee: Canon Kabushiki Kaisha, Tokyo, Japan

[21] Appl. No.: 429,869

[22] Filed: Apr. 27, 1995

[30] Foreign Application Priority Data

Apr. 28, 1994 [JP] Japan ..... 6-111855

[51] Int. Cl.[6] ..... G03G 15/09

[52] U.S. Cl. ..... 399/276

[58] Field of Search ..... 355/245, 251, 355/253, 259, 261; 118/651, 661, 653, 656–658; 430/109, 111, 120, 122; 399/267, 276, 279, 286, 252

[56] References Cited

U.S. PATENT DOCUMENTS

| | | | |
|---|---|---|---|
| 3,634,251 | 1/1972 | Maeda et al. | 252/62.1 |
| 4,590,142 | 5/1986 | Yamazaki et al. | 430/138 |
| 4,599,294 | 7/1986 | Matsumoto et al. | 430/137 |
| 4,626,490 | 12/1986 | Yamazaki et al. | 430/138 |
| 4,656,111 | 4/1987 | Wakamiya et al. | 430/109 |
| 4,797,344 | 1/1989 | Nakahara et al. | 430/138 |
| 4,888,264 | 12/1989 | Matsumoto et al. | 430/137 |
| 4,973,541 | 11/1990 | Kohri et al. | 430/111 |
| 5,004,665 | 4/1991 | Ohtani et al. | 430/111 X |
| 5,286,917 | 2/1994 | Unno et al. | 118/651 |
| 5,305,061 | 4/1994 | Takama et al. | 355/219 |
| 5,396,317 | 3/1995 | Osawa et al. | 355/269 |
| 5,400,124 | 3/1995 | Kass et al. | 355/251 |
| 5,547,724 | 8/1996 | Kuribayashi | 428/35.8 |
| 5,659,857 | 8/1997 | Yamazaki et al. | 399/252 |

FOREIGN PATENT DOCUMENTS

| | | |
|---|---|---|
| 0085927 | 8/1983 | European Pat. Off. . |
| 3414738 | 10/1984 | Germany . |
| 36-10231 | 7/1961 | Japan . |
| 43-10799 | 5/1968 | Japan . |
| 51-14895 | 5/1976 | Japan . |
| 56-13945 | 4/1981 | Japan . |
| 59-53856 | 3/1984 | Japan . |
| 59-61842 | 4/1984 | Japan . |
| 63-247762 | 10/1988 | Japan . |
| 04-246676 | 9/1992 | Japan . |

OTHER PUBLICATIONS

Patent Abstracts of Japan, vol. 13, No. 382 (P–923) [3730] Aug. 1989 for JP 1–134381.

(List continued on next page.)

*Primary Examiner*—Robert Beatty

*Attorney, Agent, or Firm*—Fitzpatrick, Cella, Harper & Scinto

[57] ABSTRACT

A developer is carried on a developer-carrying member and conveyed to a developing region to be used for developing an electrostatic latent image formed on an electrostatic latent image-bearing member. The developer includes a non-magnetic toner, and the toner includes toner particles containing 5–30 wt. % of a low-softening compound and having a shape factor SF-1 of 100–130. The developer-carrying member has a developer-carrying surface satisfying the conditions of:

$$0.2\ \mu m \leqq Ra \leqq 5.0\ \mu m,$$

$$10\ \mu m \leqq Sm \leqq 80\ \mu m,$$

and $$0.05 \leqq Ra/Sm \leqq 0.5,$$

wherein Ra denotes a center line-average roughness, and Sm denotes an average spacing between unevennesses. The toner shows good fixability and fluidity and is yet uniformly applied and conveyed to be used for developing because of the appropriate surface roughness of the developer-carrying member. The developed toner image can be transferred at a high transfer ratio.

13 Claims, 3 Drawing Sheets

OTHER PUBLICATIONS

Patent Abstracts of Japan, vol. 13, No. 475 (P-950) [3823] Oct. 1989 for JP1-186964.

Patent Abstracts of Japan, vol. 18, No. 166 (P-1713) [6506] Mar. 1994 for JP5-333602.

Lee, et al. "Glass Transition — Temperatures of Polymers", Polymer Handbook, 2nd Ed., Wiley-Interscience, pp. III-139 to III-191 (1972).

$$Ra = \frac{1}{\ell}\int_0^{\ell} |f(x)|\,dx$$

$$Sm = \frac{1}{n}\sum_{i=1}^{n} Sm_i$$

IMAGE DEVELOPING METHOD USING SPECIFIC TYPE TONER AND DEVELOPING SLEEVE ROUGHNESS

FIELD OF THE INVENTION AND RELATED ART

The present invention relates to an image forming method utilizing electrophotography, more particularly an image forming method for image forming apparatus, such as copying machines, printers and facsimile apparatus, wherein an electrostatic latent image is developed with a toner comprising toner particles having a spherical shape.

Hitherto, a toner for electrophotography has been generally produced through the pulverization-classification process wherein a blend of a resin, such as polyester resin, styrene-acrylate copolymer resin or epoxy resin, with a colorant and other additives, such as a charge control agent and a release agent, is melt-kneaded for uniform dispersion and, after cooling, pulverized to a prescribed level of particle size, followed by classification to remove excessive fine and coarse power fractions. In order to comply with a demand for higher-quality image formation in these days, it has become necessary to provide a toner of a smaller particle size. As the average particle size of a toner is reduced to 7 μm or below as measured by a Coulter counter, however, it has become extremely difficult to accomplish a uniform dispersion of starting materials, high-efficiency pulverization, and classification for providing a toner having a sharp particle size distribution, which, until now, have not been a problem for providing larger-particle size toners.

In order to overcome the problems accompanying the toner production by the pulverization-classification process, there have been proposed toner production processes utilizing suspension polymerization in Japanese Patent Publication (JP-B) 36-10231, JP-B 43-10799 and JP-B 51-14895. In such a toner production process by suspension polymerization, a monomer composition is prepared by uniformly dissolving or dispersing a polymerizable monomer, a colorant, a polymerization initiator and optional additives, such as a crosslinking agent, a charge control agent and others, and the resultant monomer composition is dispersed by appropriate stirring means into a continuous phase medium (e.g., water) containing a dispersion stabilizer, followed by polymerization to obtain a toner having a desired particle size. The production process does not include a pulverization step, therefore need not provide a toner with fragility and allows the use of a large amount of low-softening point material which cannot be used in the conventional pulverization-classification process, so that the latitude for material selection can be increased. The toner produced through the production process has characteristics such that hydrophobic components, such as a release agent and a colorant, are not readily exposed to toner particles surfaces and therefore the toner is less likely to soil the members in an electrophotographic apparatus, such as a developer-carrying member, a photosensitive member, a transfer roller or a fixing device. Such a toner directly produced through polymerization may be sometimes referred to herein as a "direct polymerization toner" or a "polymerization toner".

Further, in recent years, digital full color copying machines and printers have been commercialized, so that a toner having excellent resolution gradation characteristic and color reproducibility free from color irregularity suited for these machines is desired. In a digital full-color machine, a color image original is color-separated by respective filters of B (blue), G (green) and R (red); resultant latent images having a dot size of 20–70 μm are developed with toners in respective colors of Y (yellow), C (cyan) and M (magenta); and resultant respective color-toner images are transferred from a photosensitive member to a transfer-receiving material. In this case, a larger amount of toner has to be transferred from the photosensitive member to the transfer-receiving material than in a monochromatic machine, and a further high-quality image will be required in the future including a higher resolution. Accordingly, a further smaller size toner is expected to be suited for a smaller dot size. A lower temperature-fixability is also important for complying with a higher-speed printer or copying machine and a full-color machine. For complying with these demands, it is advantageous to produce a toner by the polymerization process capable of providing a toner having a sharp particle size distribution and a small particle size toner and also capable of enclosing a low-softening point compound within toner particles.

Color toners used in a full-color machine are required to cause sufficient color mixing of respective color toners in the fixing step. Therefore, it is important that the respective color toners provide an improved color reproducibility and a transparent image suitable for OHP projection. Compared with a black toner, a color toner is generally required to comprise a sharp-melting low-molecular weight resin so as to provide an enhanced color-mixing characteristic. An ordinary black toner contains a release agent having a relatively high crystallinity and a low clarity, such as polyethylene wax or polypropylene wax, in order to provide an enhanced anti-high-temperature offset characteristic at the time of fixation. In a color toner for full-color image formation, however, if such a high-crystallinity release agent is used, the resultant color image is provided with an impaired clarity, thus being unsuitable for production of an OHP transparency. For this reason, an ordinary color toner does not contain a release agent and it has been attempted to enhance the anti-high temperature offset characteristic by applying silicone oil onto the heat-fixation roller. However, a transfer-receiving material having a fixed image thus formed is liable to carry excessive silicone oil attached thereto and provide an unpleasant touch to the users.

For this reason, studies were conducted provide a toner for oil-less fixation containing a large amount of low-softening point substance, but a toner having excellent low temperature-fixability and clarity and also excellent anti-high temperature offset characteristic is still desired.

In an electrophotographic image forming method using a direct polymerization toner contained in a two component-type toner containing carrier particles in addition to the toner or a one component-type (i.e., carrier-free) developer, such a developer may be carried on a developer-carrying member to develop an electrostatic latent image, and the resultant toner image may be transferred onto a transfer-receiving material and fixed thereto. In such a method, it is ordinarily required to form an appropriately uniform developer layer on the developer-carrying member by using a regulating means.

When a direct polymerization toner is used in a developing device using such a developer-regulating member, the toner can slip by between the developer-carrying member and the regulating member since a polymerization toner has much better fluidity then a toner obtained through the pulverization-classification process (hereinafter sometimes called a "pulverization toner"). For this reason, the polymerization toner is liable to have nonuniform charges among toner particles and fails to provide a uniform coating layer, thus resulting in inferior images accompanied with ground fog and image irregularity. Further, in case where the developer-carrying member has a mirror-like smooth surface, the carrying member can show insufficient conveying force in a circumferential direction so that the toner is liable to be localized towards both sides of the developer-carrying member, thus causing difficulties, such as toner intrusion into bearings, etc., occurrence of toner melt-sticking and transfer failure, during a long period of repetitive image formation.

A direct polymerization toner is generally substantially spherical and tends to form a closest packing state in a developing device and is sometimes packed densely at a downstream side of the regulating member in the developing device, thereby increasing the mechanical load acting on the toner to cause a sleeve soiling due to toner melt-sticking onto the developer-carrying member (sleeve). The sleeve soiling leads to a lowering in image density and ground fog, thus being undesirable. This difficulty is more pronounced in case of a polymerization toner containing a large amount of low-softening point substance.

JP-A 63-247762 has proposed a polymerization toner prepared by a direct polymerization process from a monomer composition containing 50–3000 wt. parts of a low-softening point substance, such as paraffin wax, per 100 wt. parts of the monomer, in combination with a developer-carrying member having a certain surface roughness (Rz.max). The developer-carrying member showed a toner melt-sticking-prevention effect in an initial stage of repetitive image formation but some toner melt-sticking was observed in a later stage of the repetitive image formation. Thus, it has been difficult to stably and continually convey a toner having a good fluidity by controlling only the surface roughness (Rz.max) of the developer-carrying member (sleeve).

SUMMARY OF THE INVENTION

A general object of the present invention is to provide an image forming method having solved the above-mentioned problems.

A more specific object of the present invention is to provide an image forming method capable of providing images free from image density irregularity or fog and with excellent image quality and fixing state even in case of continuous image formation.

Another object of the present invention is to provide an image forming method capable of stably providing images without causing toner melt-sticking onto a developer-carrying member.

According to the present invention, there is provided an image forming method, comprising:

conveying a developer carried on a developer-carrying member to a developing region, wherein the developer comprises a toner, and the toner comprises toner particles containing 5–30 wt. % of a low-softening compound and having a shape factor SF-1 of 100–130; the developer-carrying member having a developer-carrying surface satisfying the conditions of:

$$0.2\ \mu m \leqq Ra \leqq 5.0\ \mu m,$$

$$10\ \mu m \leqq Sm \leqq 80\ \mu m,$$

and $$0.05 \leqq Ra/Sm \leqq 0.5,$$

wherein Ra denotes a center line-average roughness, and Sm denotes an average spacing between unevenness; and developing an electrostatic latent image formed on an electrostatic latent image-bearing member with the developer in the developing region.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
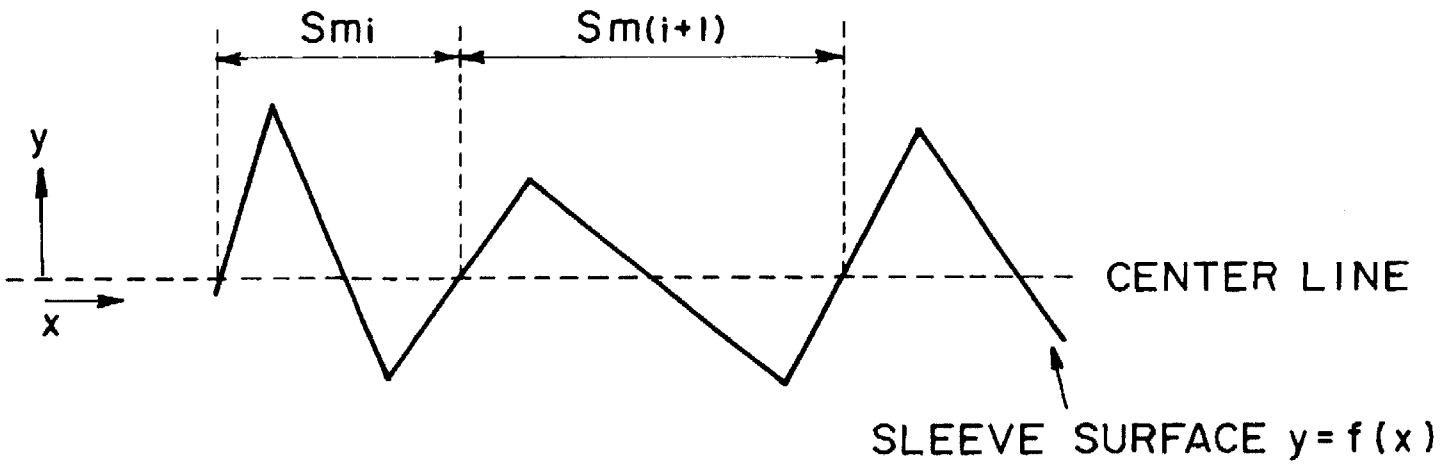
FIG. 1 is an illustration of a surface state of a developer-carrying member (sleeve).

The toner used in the present invention comprises toner particles having a shape factor SF-1 of 100–130 and shows a good fluidity. It is preferred that the toner shows an agglomeratability (as a measure of fluidity) of at most 30%, more preferably 3–25%, so that a toner image formed on a photosensitive member (as an electrostatic latent image-bearing member) is effectively transferred to an intermediate transfer member or a transfer-receiving material to show a high transfer ratio of at least 93% Even a toner having a shape factor SF-1 of 100–130 could show a somewhat lower transfer ratio when it was blended with an additive showing an extremely poor fluidity to provide a developer showing an agglomeratability exceeding 30%. On the other hand, in the case where the agglomeratability is below 3%, the transfer ratio is high but an undesirable toner scattering around an image is liable to occur. In this way, a toner showing a shape factor SF-1 of 100–130 provides a remarkable improvement particularly in the transfer state of an electrophotographic process but, because of its good fluidity, can cause disadvantageous phenomena, such as toner slipping by the regulating member and nonuniform localization of the toner on the developer-carrying member, resulting in a difficulty in maintenance of high-quality images.

The toner used in the present invention contains 5 30 wt. % of a low-softening point compound so as to show an improved low temperature-fixability and is therefore liable to show a substantially lower resistance to an external force such as shearing. Further, the toner has a substantially spherical shape and shows an extremely good fluidity, but the toner has to be applied uniformly onto the developer-carrying member without applying an excessive load onto the toner since the toner contains 5–30 wt. % of a low-softening point compound and is rich in deformability.

The developer-carrying member used in the present invention satisfy the following conditions:

$$0.2\ \mu m \leqq \text{center line-average roughness (Ra)} \leqq 5.0\ \mu m,$$

$$10\ \mu m \leqq \text{average unevenness spacing (Sm)} \leqq 80\ \mu m,$$

$$0.05 \leqq Ra/Sm \leqq 0.5.$$

The parameters Ra and Sm refer to a center line-average roughness and an average unevenness spacing defined by JIS B0601 (and ISO 468) and obtained by the following:

$$Ra = (1/l)\int_0^l |f(x)|dx$$

$$Sm = (1/n)\sum_{i=1}^{n} Smi$$

If Ra is below 0.2 μm, the developer-carrying member shows an insufficient toner-conveying ability so that an image density irregularity is liable to be caused particularly in a continuous image formation. If Ra exceeds 5 μm, the developer-carrying member is excellent in toner-conveying ability but exerts too large a constraint force at a developer conveying regulation zone as by a regulating blade to cause deterioration by rubbing of an external additive to the toner particle surfaces, thus being liable to cause a lowering in image quality during a successive image formation.

If Sm exceeds 80 μm, the retention of a toner on the developer-carrying member becomes difficult to result in a lower image density. The mechanism thereof has not been fully clarified as yet but, in view of a phenomenon that a slippage of toner on the developer-carrying member is caused at the conveyance regulating zone of the developer-carrying member, it is assumed that the toner is densely packed to form a cake in case of too large an unevenness spacing and a force acting on the cake exceeds a retention force acting between the toner-developer-carrying member, thus resulting in a lower image density. If Sm is below 10 μm, many of unevennesses on the developer-carrying member become smaller than the average particle size of the toner, so that a particle size selection of toner entering the concavities occurs, thus being liable to cause melt-sticking of the toner fine powder fraction. Further, the production of the developer-carrying member is not easy.

In further view of the above-described points, an unevenness slope (≈f(Ra/Sm)) obtained from a convexity height and an unevenness spacing on the developer-carrying member also becomes an important actor. In the present invention, a relationship of $0.5 \geqq Ra/Sm \geqq 0.05$ is required and preferably $0.3 \geqq Ra/Sm \geqq 0.07$.

If Ra/Sm is below 0.05, the developer-carrying member shows too small a toner-retention force so that the retention of toner on the developer-carrying member becomes difficult and the conveyance to the developer regulation zone is not controlled, whereby an image density irregularity is liable to be caused. If Ra/Sm exceeds 0.5, the toner entering the concavities is not mixed circulatively with the other toner, so that the toner melt-sticking is liable to occur.

If the developer-carrying member is provided with a plurality of grooves extending in the axial direction thereof or in a direction generally perpendicular to the direction of a relative movement of the developer thereon (i.e., provided with a knurled surface), it becomes easier to further uniformly apply even a toner having an excellent fluidity on the developer-carrying member.

Such grooves may preferably have a width and a depth, respectively, of, e.g., 100–1000 μm and may preferably be formed with spacings of 2–7 mm each so as to provide a total of, e.g., 5–15 grooves for an ordinary diameter of cylindrical sleeve. In case where such grooves are formed, the above-mentioned parameters Ra and Sm are measured at points of spacings between the grooves.

Recently, there is an increasing desire of using a small particle size toner for providing higher quality images. In connection with such a desire, it becomes important to strictly regulate the surface roughness of the developer-carrying member for a toner having a particle size distribution such that it has a weight-average particle size of 4–8 μm and a number-basis particle size variation coefficient of at most 35%. When a toner having a weight-average particle size of 4–8 μm is produced through the pulverization process, ultra-fine powder is inevitably by-produced and it is sometimes difficult to remove such ultra-fine powder even by a classification step. Even in the case of a direct polymerization toner, unless it has a number-basis particle size variation coefficient of at most 35%, such ultra-fine powder is liable to be accumulated at concavities of the developer-carrying member even if the surface roughness is regulated, thus resulting in soiling of the developer-carrying member.

The values of Ra and Sm described herein are based on those measured according to JIS-B0601 by using a contact-type surface roughness tester ("SE-3300", mfd. by Kosaka Kenkyusho K.K>) by using a measurement length l of 2.5 mm and effecting measurement at arbitrarily selected several points on the surface of a developer-carrying member.

A developer-carrying member (sleeve) may be provided with a prescribed surface roughness, e.g., by sand blasting with abrasive particles comprising irregularly shaped or regularly shaped particles, rubbing of the sleeve with sand paper in directions in parallel with the axis thereof (i.e., directions perpendicular to the developer-conveying direction) for providing unevenness preferentially formed in the circumferential direction, chemical treatment, and coating with a resin followed by formation of resinous projections.

The developer-carrying member used in the present invention may be composed of a known material, examples of which may include: metals, such as aluminum, stainless steel, and nickell a metal body coated with carbon, a resin or an elastomer; and elastomer, such as natural rubber, silicone rubber, urethane rubber, neoprene rubber, butadiene rubber and chloroprene rubber in the form of an unfoamed, or foamed or sponge form, optionally further coated with carbon, a resin or an elastomer.

The developer-carrying member used in the present invention may assume a shape of a cylinder or a sheet.

In the case where the developer-carrying member is in the form of a cylindrical developing sleeve, the developing sleeve may preferably have a diameter of 12–30 mm, more preferably 15–25 mm, in view of developing efficiency and suppression of toner melt-sticking. In the case where the toner is a magnetic toner or constitutes a two-component type developer comprising a non-magnetic toner and a magnetic carrier, a magnetic field-generating means, such as a magnet is disposed inside the developer-carrying member.

The shape factor SF-1 referred to herein is based on values measured in the following manner.

Images of 100 toner particles observed through a field emission scanning electron microscope (FE-SEM) ("S-800", available from Hitachi Seisakusho K.K.) at a magnification of, e.g., 500 are sampled at random, and the image data of the toner images are inputted for analysis into an image analyzer (e.g., "Luzex III", available from Nireco K.K.) through an interface, whereby the shape factor SF-1 is calculated by the following equation:

$$SF\text{-}1=[(MXLNG)^2/AREA]\times(\pi/4)\times 100,$$

wherein MXLNG denotes the maximum diameter of a toner particle and AREA denotes the projection area of the toner particles. The shape factor SF-1 referred to herein is defined as a number-average value of SF-1 values calculated in the above-described manner for the 100 toner particles selected at random.

In case where the shape factor SF-1 larger than 130, the toner particles are substantially deviated from spheres but approach indefinite or irregularly shaped particles and correspondingly show a lowering in transfer efficiency (or transfer ratio).

In order to realize a high transfer efficiency, the toner should have a shape factor SF-1 of 100–130, preferably 100–120, so as to be substantially spherical. In order to faithfully develop further minute latent image dots for providing a higher image quality, the toner may preferably have a weight-average particle size of 4–8 μm and a number-basis variation coefficient of at most 35%. A toner having a weight-average particle size of below 4 μm is liable to cause a lowering in transfer efficiency to result in a substantial amount of residual toner on the photosensitive member or intermediate transfer member, leading to image irregularity due to fog and transfer failure. A toner having a weight-average particle size over 8 μm is liable to cause melt-sticking onto various members and this tendency is enhanced when the number-basis particle size variation coefficient exceeds 35%.

In the present invention, the toner particles contain a low-softening point compound (i.e., a compound showing a low-softening point). The low-softening point compound may preferably provide a DSC curve, as measured by a differential scanning colorimeter according to ASTM D3418-8, showing a temperature of 40°–90° C. corresponding to a maximum heat absorption peak. If the temperature is below 40° C., the low-softening point compound is lowered in its self-cohesive force, thus resulting in a decreased anti-offset characteristic at high temperatures. This is particularly unsuitable for a color toner for full color development. On the other hand, if the temperature is above 90° C., the fixation temperature is increased, so that it is difficult to moderately smooth the surface of a fixed image, thus resulting in a lowering in a color-mixing characteristic. In the case of producing toner particles by direct polymerization, steps of forming particles and polymerization are performed in an aqueous medium, so that the low-softening point compound precipitates principally in the step of forming particles if the maximum heat-absorption peak temperature is high (e.g., above 90° C.).

Measurement of the temperature corresponding to a maximum heat absorption peak on a DSC curve described above may be performed by using, e.g., a commercially available differential scanning calorimeter ("DSC-7" (trade name), manufactured by Perkin-Elmer Corp.). In the apparatus, temperature correction at a sensor portion is effected by using melting points of indium and zinc and correction of heat quantity at the sensor portion is effected by using a heat of fusion of indium. For the measurement, a sample is placed on an aluminum pan and a blank pan is set for reference. The DSC measurement is performed by heating (temperature increase) at a rate of 10° C./min.

Examples of the low-softening point compound may include paraffin wax, polyolefin wax, Fischer Tropsch wax, amide wax, higher fatty acid, ester wax, and derivatives thereof (e.g., grafted compounds thereof and blocked compounds thereof).

The low-softening point compound may preferably be an ester wax having at least one long-chain hydrocarbon group having 10 or more carbon atoms. Such an ester wax may particularly preferably be those represented by the following formulae (I)–(Iv):

$$[R_1-COO-(CH_2)_n]_a-C-[(CH_2)_m-OCO-R_2]_b, \quad (I)$$

wherein a and b each are an integer of 0–4 with the proviso that a+b=4; $R_1$ and $R_2$ independently denote an organic group having 1–40 carbon atoms with the proviso that a difference in carbon number between $R_1$ and $R_2$ is at least 10; and n and m each are an integer of 0–15 with the proviso that n and m are not 0 simultaneously.

$$[R_1-COO-(CH_2)_n]_a-C-[(CH_2)_m-OH]_b, \quad (II)$$

wherein a and b each are an integer of 0–4 with the proviso that a+b=4; $R_1$ denotes an organic group having 1–40 carbon atoms; and n and m each are an integer of 0–15 with the proviso that n and m are not 0 simultaneously.

$$R_1-COO-R_2 \quad (IV),$$

wherein $R_1$ and $R_2$ independently denote an organic group having 15–45 carbon atoms.

The ester wax preferably used in the present invention may preferably have a hardness of 0.5–5.0. The hardness of the ester wax may be measured by using, e.g., a dynamic ultra-minute hardness meter ("DUH-200", available from Shimazu Seisakusho K.K.) in the following manner. An ester compound is melted and molded into a 5 mm-thick cylindrical pellet in a 20 mm dia.-mold. The sample is pressed by a Vickers pressure element at a load of 0.5 g and a loading rate of 9.67 mg/sec to cause a displacement of 10 μm, followed by holding for 15 sec. Then, the pressed mark on the sample is analyzed to measure a Vickers hardness.

An ester wax having a hardness of below 0.5 provides a toner showing large dependences of fixing performance on pressure and process speed at the fixing device, thus being liable to show an insufficient anti-high temperature offset characteristic. On the other hand, if the hardness exceeds 5.0, the resultant toner is liable to have insufficient storage stability and insufficient anti-high temperature offset characteristic because of small self-cohesion of the ester wax per se.

Specific examples of the ester wax may include those represented by the following structural formulae:

| Ex. Wax No. | Structural Formula |
|---|---|
| (1) | 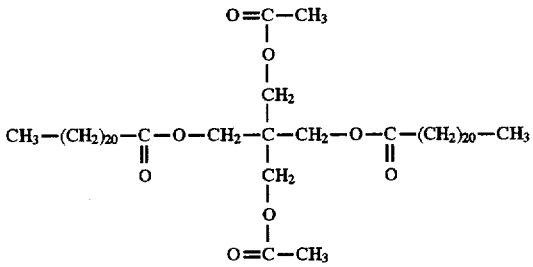 |
| (2) | 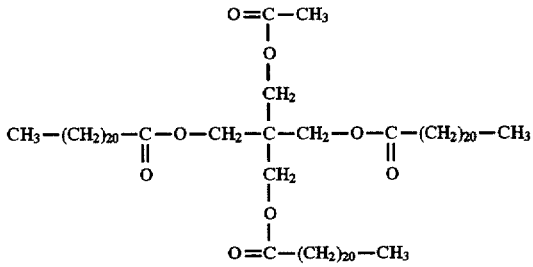 |
| (3) | 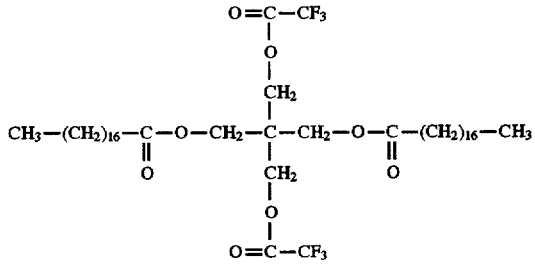 |
| (4) | 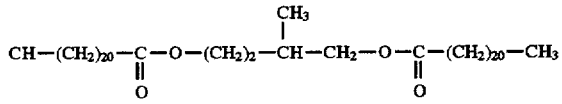 |

In recent years, full-color double-side toner images have been increasingly desired. In the case of forming such double-side toner images, a transfer-receiving material having a toner image formed on one of the surfaces thereof through a fixation step is again passed through a heated region of a fixing device at the time of forming a toner image on the other surface thereof, so that it is required to take a high-temperature offset characteristic of toner particles into account in particular. For this reason, the addition amount of the low-softening point compound is an important factor in the present invention. More specifically, the low-softening point compound may preferably be contained in the toner particles in an amount of 5–30 wt. %. If the addition amount is below 5 wt. %, a high-temperature anti-offset characteristic of the toner particles is lowered and a toner image formed on the back side of the transfer-receiving material is liable to cause an offset phenomenon at the time of fixing both-side toner images. If the addition amount is in excess of 30 wt. %, in toner production by the polymerization process, coalescence of toner particles is liable to occur at the time of forming particles, thus being liable to provide a wider particle size distribution of the resultant toner particles.

The toner particles used in the present invention can be produced by various methods including:

(i) pulverization and classification followed by an optional sphearing or rounding step: wherein a toner composition comprising a resin, a low-softening point compound as a release agent, a colorant, a charge control agent, etc. is uniformly dispersed by a dispersing device such as a pressure kneader or an extruder and finely pulverized so as to have a desired toner particle size by effecting impingement of the toner composition against a target by the action of mechanical force or jet air stream, and is classified to obtain toner particles having a sharp particle size distribution, optionally further followed by shering or smoothing treatment.

(ii) melt-spraying method: wherein a melt mixture of toner ingredients is sprayed in the air by using a disk or a fluidic multi-nozzle to obtain spherical toner particles (as disclosed in Japanese Patent Publication (JP-B) 56-13945), and (iii) direct polymerization process as follows:

(a) suspension polymerization for directly providing toner particles as disclosed in JP-B 36-10231, JP-A 59-53856, and JP-A 59-61842, (b) dispersion polymerization wherein an aqueous organic solvent in which a monomer is soluble but a polymer is insoluble is used to directly obtain toner particles, and (c) emulsion polymerization such as soap-free polymerization wherein a polymerizable monomer composition is polymerized in the presence of a water-soluble polar polymerization initiator to obtain toner particles.

Among the above production methods, it is however difficult to provide the resultant toner particles with an SF-1 of 100–130 by the pulverization and classification process. In the melt-spraying method, it is possible to provide an SF-1 in an appropriate range but the resultant toner particles are liable to have a wider particle size distribution, so that this method is not efficient. In the dispersion polymerization, the resultant toner particles show a very sharp particle size distribution but the production apparatus is liable to be complicated in view of a narrow latitude in selecting material used, waste solvent disposal and flammability of the solvent used. The emulsion polymerization or soap-free polymerization is effective in providing a relatively uniform particle size distribution but is liable to worsen environmental characteristics due to the presence of the emulsifying agent or polymerization initiator at the surface of the toner particles.

Accordingly, the suspension polymerization under normal pressure or an elevated pressure may preferably be used in the present invention because an SF-1 of the resultant toner particles can readily be controlled in a range of 100–130 pad fine toner particles having a sharp particle size distribution and a weight-average particle size of 4–8 μm can be obtained relatively easily. In the present invention, it is also possible to suitably use seed polymerization wherein polymerization particles once obtained are adsorbed by a polymerizable monomer and are polymerized by using a polymerization initiator. Further, it is also possible to preferably adopt a salting-association process wherein primary emulsion polymerization particles are formed with only little or no emulsifier and then subjected to association by salting or by addition of polymer particles with an opposite electric charge in an aqueous medium, or a heterogeneous agglomeration method for producing toner particles.

Figure 2:
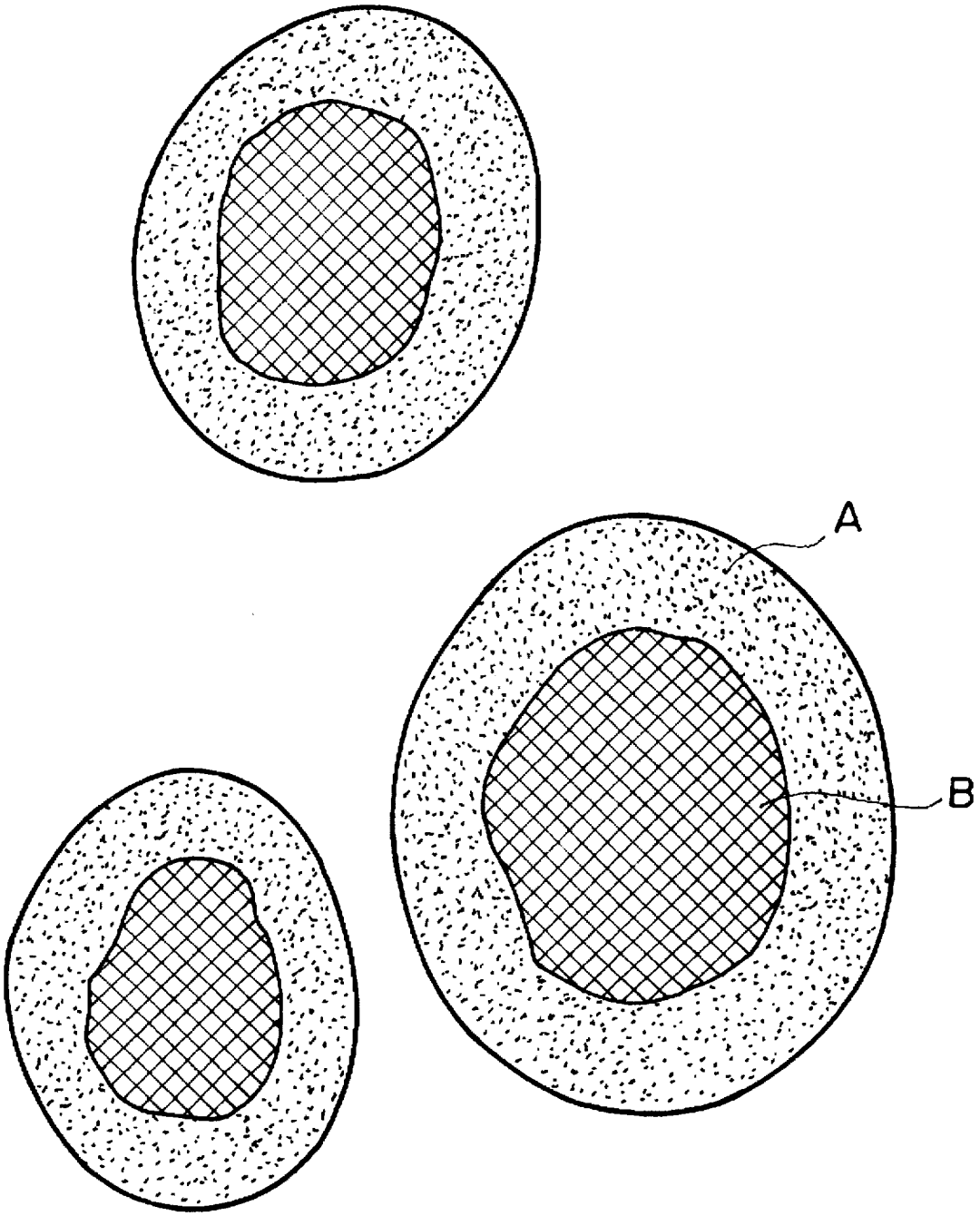
FIG. 2 is a schematic sectional view of toner particles preferably used in the present invention (Example 1).

The toner used in the present invention comprises toner particles having a shape factor SF-1 of 100–130, contains 5–30 wt. % of a low-softening point compound and may preferably comprise toner particles having a microstructure wherein a low-softening compound B is encapsulated with an outer shell A as illustrated in FIG. 2 when its sectional structure is observed through a transmission electron microscope.

A large amount of the low-softening compound is required to be contained in the toner in order to provide a good fixability, so that the low-softening compound may preferably be enclosed or encapsulated within the outer shell. Such an enclosed structure of the low-softening compound in the toner particles may be obtained through a process wherein the low-softening compound is selected to have a polarity in an aqueous medium which polarity is lower than that of a principal monomer component and a small amount of a resin or monomer having a larger polarity is added thereto, to provide toner particles having a core-shell structure. The toner particle size and its distribution may be controlled by changing the species and amount of a hardly water-soluble inorganic salt or a dispersant functioning as a protective colloid; by controlling mechanical apparatus conditions, such as a rotor peripheral speed, a number of pass, and stirring conditions inclusive of the shape of a stirring blade; and/or by controlling the shape of a vessel and a solid content in the aqueous medium.

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the low-softening point compound and the outer resin by utilizing a difference in crystallinity therebetween. A typical preferred cross-section of toner particles is shown in FIG. 2, wherein the low-softening point compound B is enclosed within the outer shell resin A.

In the present invention, the binder resin may comprise various resins such as styrene-(meth)acrylate copolymer, polyester resin, epoxy resin and styrene-butadiene copolymer.

In the case of directly producing the toner particles through the polymerization process, the monomer may preferably be a vinyl-type monomer, examples of which may include: styrene and its derivatives such as styrene, o-, m- or p-methylstyrene, and m- or p-ethylstyrene; (meth) acrylic acid esters such as methyl (meth)acrylate, ethyl (meth)acrylate, propyl (meth)acrylate, butyl (meth)acrylate, octyl (meth)acrylate, dodecyl (meth)acrylate, 2-ethylhexyl (meth)acrylate, stearyl (meth)acrylate, behenyl (meth) acrylate, dimethylaminoethyl (meth)acrylate, and diethylaminoethyl (meth)acrylate; butadiene; isoprene; cyclohexene: (meth)acrylonitrile, and acrylamide. These monomers may be used singly or in mixture of two or more species.

The above monomers may preferably have a theoretical glass transition point (Tg), described in "POLYMER HANDBOOK", second addition, III-pp. 139–192 (available from John Wiley & Sons Co.), of 40°–75° C. as it is or in mixture. If the theoretical glass transition point is below 40° C., the resultant toner particles are lowered in storage stability and durability. On the other hand, the theoretical glass transition point is in excess of 75° C., the fixation temperature of the toner particles is increased, whereby respective color toner particles have an insufficient color-mixing characteristic particularly in the case of the full-color image formation. As a result, the resultant toner particles have a poor color reproducibility and undesirably lower a transparency of an OHP image.

In the present invention, the molecular-weight distribution of the binder resin or outer shell resin may be measured by gel permeation chromatography (GPC) as follows.

In the case of toner particles having a core-shell structure, the toner particles are subjected to extraction with toluene for 20 hours by means of Soxhlet extractor in advance, followed by distilling-off of the solvent (toluene) to obtain an extract. An organic solvent (e.g.,chloroform) in which a low-softening point substance is dissolved and an outer resin is not dissolved is added to the extract and sufficiently washed therewith to obtain a residue product. The residue product is dissolved in tetrahydrofuran (THF) and subjected to filtration with a solvent-resistant membrane filter having a pore size of 0.3 μm to obtain a sample solution (THF solution) The sample solution is injected in a GPC apparatus ("GPC-150C", available from Waters Co.) using columns of A-801, 802, 803, 804, 805, 806 and 807 (manufactured by Showa Denko K.K.) in combination. The identification of sample molecular weight and its molecular weight distribution is performed based on a calibration curve obtained by using monodisperse polystyrene standard samples. In the present invention, the binder resin (outer shell resin) may preferably have a number-average molecular weight (Mn) of 5,000–1,000,000 and a ratio of weight-average molecular weight (Mw) to Mn (Mw/Mn) of 2–100.

In order to enclose the low-softening point compound in the outer resin (layer), it is particularly preferred to add a polar resin. Preferred examples of such a polar resin may include styrene-(meth)acrylate copolymer, maleic acid-based copolymer, saturated polyester resin and epoxy resin. The polar resin may particularly preferably have no unsaturated group capable of reacting with the outer resin or a vinyl monomer constituting the outer resin. This is because if the polar resin has an unsaturated group, the unsaturated group can cause crosslinking reaction with the vinyl monomer, thus resulting in an outer resin having a very high molecular weight, which is disadvantageous because of a poor color-mixing characteristic.

The colorant used in the present invention may include a black colorant, yellow colorant, a magenta colorant and a cyan colorant.

Examples of the black colorant may include: carbon black, a magnetic material, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the binder resin. A black colorant comprising a magnetic material, unlike the other colorants, may preferably be used in a proportion of 40–150 wt. parts per 100 wt. parts of the binder resin.

The charge control agent used in the present invention may include known charge control agents. The charge control agent may preferably be one which is colorless and has a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids such as salicylic acid, naphtoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent used in the present invention may preferably be used in a proportion of 0.5–10 wt. parts per 100 wt. parts of the binder resin. However, the charge control agent is not an essential component for the toner particles used in the present invention. The charge control agent can be used as an optional additive in some cases. In the case of using two-component developing method, it is possible to utilize triboelectric charge with a carrier. In the case of using a non-magnetic one-component blade coating developing method, it is possible to omit a charge control agent by positively utilizing a triboelectric charge through friction with a blade member or a sleeve member.

Examples of the polymerization initiator usable in the direct polymerization may include: azo-or diazo-type polymerization initiators, such as 2,2'-azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while making reference to 10-hour half-life period temperature.

In order to control the molecular weight of the resultant binder resin, it is also possible to add a crosslinking agent, a chain transfer agent, a polymerization inhibitor, etc.

The toner may further contain an additive which may be internally added into toner particles and externally added outside the toner particles. Such an additive may preferably be in the form of particles having a particle size which is at most ⅕ of the volume-average particle size of the toner particles in view of its durability when added internally or externally. The average particle size of an additive refers to an average particle size obtained by observation of surface states of toner particles through an electron microscope. Examples of the additive may include the following.

1) Flowability imparting agents, such as particles of metal oxides inclusive of silicon oxide, aluminum oxide and titanium oxide, carbon black, and fluorinated carbon. These materials may preferably be subjected to a hydrophobicity-imparting treatment.
2) Abrasives, inclusive of: particles of metal oxides such as strontium titanate, cerium oxide, aluminum oxide, magnesium oxide, and chromium oxide; nitrides, such as silicon nitride; carbide, such as silicon carbide; and metal salts, such as calcium sulfate, barium sulfate and calcium carbonate.
3) Lubricants, inclusive of: powder of fluorine-containing resins, such as polyvinylidene fluoride, and polytetrafluoroethylene; and aliphatic acid metal salts, such as zinc stearate, and calcium stearate.
4) Charge-controlling particles, inclusive of: particles of metal oxides, such as tin oxide, titanium oxide, zinc oxide, silicon oxide, and aluminum oxide, and carbon black.

These additives may be added in a proportion of 0.1–10 wt. parts, preferably 0.1–5 wt. parts, per 100 wt. parts of the toner particles. These additives may be used singly or in combination of plural species.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may also be produced by direct polymerization in the following manner. Into a polymerizable monomer, a release agent comprising the low-softening chart compound, a colorant, a charge control agent, a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90 ° C. The temperature can be raised at a latter stage of the polymerization. It is also possible to subject a part of the aqueous system to distillation in a latter stage of or after the polymerization in order to remove the yet-polymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

The agglomeratability of a toner referred to herein are based on values measured by using a powder tester (Model "PT-D", available from Hosokawa Micron K.K.) in an environment of 23° C. and 60% RH in the following manner.

(1) A sample toner is left standing in the measurement environment for 12 hours and 5.0 g thereof is weighed accurately.

(2) On a vibration table, a 60 mesh-sieve (opening: 250 μm), a 100 mesh-sieve (opening: 150 μm) and a 200 mesh-sieve are stacked and set in this order from the above to the below.

(3) The accurately weighed 5.0 g of the sample toner is gently placed on the sieves (on the 60 mesh-sieve) and the sieves are vibrated under application of DC 1.7–1.75 volts for 15 sec.

(4) The weights of the toner left on the respective sieves are gently and accurately weighed.

(5) The agglomeratability of the sample toner is calculate as follows.

Agglomeratability (%)=a+b+c, where a, b and c are values obtained by the following equations:

a=(Toner weight (g) left on the 60 mesh-sieve/5)×100 b=(Toner weight (g) left on the 100 mesh-sieve/5)×100×3/5, c=(Toner weight (g) left on the 200 mesh-sieve/5)×100×1/5.

The particle size distribution of a toner may be measured in the following manner.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.) are connected.

For measurement, a 1%-NaCl aqueous solution as an electrolyte solution is prepared by using a reagent-grade sodium chloride. To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 micron-aperture to obtain a number-basis distribution. From the results of the number-basis distribution, the weight-average particle size of the toner may be obtained.

To the toner particles obtained in the above-described manner, external additives may be added as desired to provide a toner. The toner may be further blended with a carrier to provide a two-component type developer.

The toner used in the image forming method according to the present invention may be constituted into either of a known magnetic or non-magnetic one-component type developer or a known two-component type developer. However, in the case of a one-component type developer, the unevenness distribution on the developer-carrying member is liable to be reflected in the resultant images, so that it is preferred to use a two-component type developer.

The magnetic carrier constituting such a two-component type developer, e.g., when combined with a non-magnetic toner having a weight-average particle size of 4–8 μm, may preferably have a weight-average particle size of 10–40 μm and a saturation magnetization (σs) of 30–70 emu/g as measured by applying a magnetic field of 3000 oersted.

If the magnetic carrier has a saturation magnetization exceeding 70 emu/g under an applied magnetic field of 3000 oersted, the ears of the resultant magnetic brush formed by the magnetic carrier and the toner are densely packed on the developer-carrying member (developing sleeve) confronting with an electrostatic latent image formed on the photosensitive member and are caused to provide a lower gradation characteristic and a lowering in halftone reproducibility. On the other hand, if the saturation magnetization is below 30 emu/g, it become difficult to well retain the toner and the magnetic carrier on the developer-carrying member, thus being liable to cause difficulties, such as magnetic carrier attachment and toner scattering.

In the case of a two-component type developer, it is preferred to use 1–15 wt. parts, more preferably 1.5–10 wt. parts, of a toner per 100 wt. parts of the magnetic carrier.

The developer-carrying member used in the present invention may be combined with an image-bearing member which may preferably have an outermost layer comprising polycarbonate resin in which a fluorine-containing compound and/or a silicon compound is contained in the form of dispersed fine particles of at most 5.0 μm or in dissolution so that the outermost layer is disposed within about 90 Å from the surface layer of the charge transport layer and/or the protective layer. This is advantageous in retaining a high efficiency of toner transfer from the image-bearing member. This is particularly preferred in the case of using an intermediate transfer member.

Figure 3:
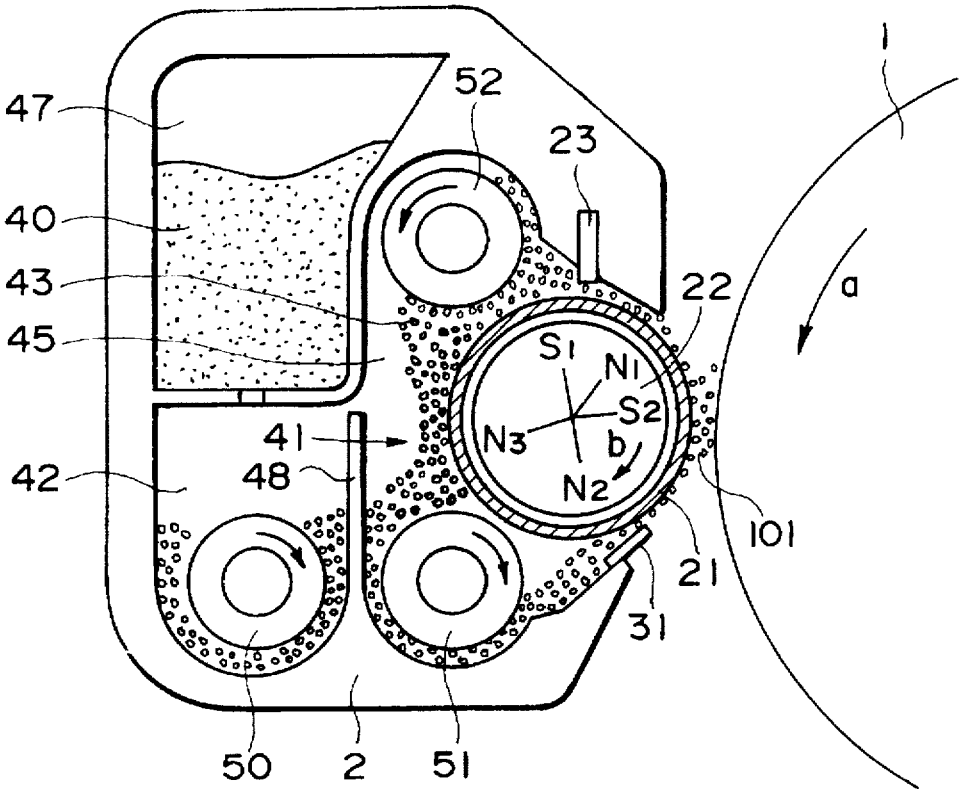
FIG. 3 is a schematic illustration of an image forming apparatus capable of practicing an embodiment of the image forming method according to the present invention.

A developing apparatus suitably used in an embodiment of the image forming method according to the present invention is illustrated in FIG. 3.

Referring to FIG. 3, the developing apparatus includes a developer container 2 having a developer chamber 45 in which a non-magnetic developing sleeve (developer-carrying member) 21 having a specific surface shape is disposed opposite to an electrostatic latent image-bearing member 1 rotated in an arrow a direction. In the developing sleeve 21, a magnetic roller 2 as a magnetic field-generating means is disposed immovably and provided with magnetic poles $S_1$, $N_1$, $S_2$, $N_2$ and $N_3$ in this order in an arrow b direction from the pole $S_1$ disposed almost at the highest position.

The developing chamber 45 contains a two-component-type developer 41 comprising a mixture of a non-magnetic toner 40 having a shape factor SF-1 of 100–130 and a magnetic carrier 43.

The developer 41 is introduced into a stirring chamber 42 equipped with a partitioning wall 48 having an upper opening end through one opening (not shown) of the wall 48 at one end of the developing chamber 45 in the developer container 2. Into the stirring chamber 42, the non-magnetic toner 40 is replenished from a toner chamber 47 and the developer 41 conveyed toward the other end of the stirring chamber 42 while being mixed with a first developer stirring and conveying means 50. The developer 41 conveyed to the other end of the stirring chamber 42 is returned to the developing chamber 45 through the other opening (not shown) of the partitioning wall 48 and stirred and conveyed by a second developer stirring and conveying means 51 in the developing chamber 45 and a third developer stirring and conveying means 52 disposed ta an upper part in the developing chamber 45 and conveying the developer in direction opposite to the conveying direction of the conveying means 51, whereby the developer is supplied to the developing sleeve 21.

The developer 41 supplied to the developing sleeve 21 magnetically constrained under the action of a magnetic force exerted by the magnet roller 22 and carried on the developing sleeve 21. The developer 41 is formed into a thin layer under the regulation of a developer regulating blade 23 disposed confronting almost the highest position of the developing sleeve 21 and conveyed along with the rotation of the developing sleeve 21 in the arrow b direction to a developing zone 101 confronting the electrostatic latent image-bearing member 1, where the developer is used for developing an electrostatic latent image on the latent image-bearing member 1. The developer 41 not consumed for development is recovered into the developer container 2 along with the rotation of the developing sleeve 21.

In the developer container 2, the residual developer magnetically constrained on the developing sleeve 21 is peeled off from the developing sleeve 21 by a repulsive magnetic field acting between poles $N_2$ and $N_3$ of the same polarity. In order to prevent scattering of the toner at the time when the developer 41 stands up to form ears along magnetic lines of force caused by the pole $N_2$, an elastic sealing member 31 is fixedly disposed at a lower part of the developer container 2 so that its one end contacts the developer 41.

The magnetic performances of the magnetic carrier are affected by the magnet roller 22 contained in the developing sleeve and in turn affect the developing performances and conveying characteristic of the developer.

In a preferred embodiment, of the developing sleeve and the magnet roller disposed inside thereof, e.g. the magnet roller is fixed and the developing sleeve alone is rotated so as to circulatively convey a two-component type developer comprising a magnetic carrier and an insulating non-magnetic color toner, whereby an electrostatic latent image formed on the electrostatic latent image-bearing member is developed with the two-component type developer. In this instance, if (1) the magnet roller is provided with five poles including repulsive poles, (2) the magnetic flux in the developing region is set to 500–1200 gauss and (3) the magnetic carrier is set to have a saturation magnetization of 30–70 emu/g, color image formation may suitably be performed so as to provide excellent uniformity of images, gradation reproducibility and continuous image forming characteristic.

Hereinbelow, the present invention will be described based on Examples.

EXAMPLE 1

A developing sleeve (SUS, diameter=25 mm, mfd. by Hitachi Kinzoku K.K.) used in a full-color copying machine ("LC500", available from Canon K.K.) equipped with an OPC photosensitive drum, a developing apparatus of a magnetic brush-type, a transfer drum and a hot-pressure roller fixing device, was sand-blasted with irregularly shaped alumina particles having an average particle size of ca. 100 μm by using a sand blaster ("Pneumablaster", available from Fuji Seisakusho K.K.) to form a blasted sleeve of Ra=2.1 μm and Sm=29.6 μm (Ra/Sm=0.07).

A toner was prepared in the following manner. Into a 2 liter-four necked flask equipped with a high-speed stirrer ("TK-Homomixer", available from Tokushu Kika Kogyo K.K.), 710 wt. parts of deionized water and 450 wt. parts of a 0.1 mol/liter-$Na_3PO_4$ aqueous solution was charged ad warmed at 65° C. under stirring at 12,000 rpm. Into the flask, 68 wt. parts of a 1.0 mol/liter-$CaCl_2$ aqueous solution was gradually added to prepare an aqueous dispersion medium containing fine form of hardly water-soluble dispersing agent $Ca_3(PO_4)_2$. On the other hand, a monomer composition was prepared as follows:

| | |
|---|---|
| Styrene monomer | 165 wt. parts |
| n-Butyl acrylate monomer | 35 wt. parts |
| C.I. Pigment Blue 15:3 | 14 wt. parts |
| Saturated polyester resin (terephthalic acid/propylene oxide modified bisphenol A; acid value = 15, peak molecular weight = $6 \times 10^3$) | 10 wt. parts |
| Dialkylsalicylic acid metal compound | 2 wt. parts |
| Ester wax compound (1) (described hereinbefore, DSC absorption peak temp. = 59.4° C., hardness = 1.5) | 60 wt. parts |

The above mixture was dispersed for 3 hours by means of an attritor and then 10 wt. parts of 2,2'-azobis-(2,4-dimethylvaleronitrile) (polymerization initiator) was added thereto to formulate a monomer composition, which was then charged into the above-prepared dispersion medium, followed by particle formation for 15 min. under the retained rotation speed. Thereafter, the high-speed stirrer was replaced by propeller stirring blades, and the system temperature was raised to 80° C. to effect polymerization for 10 hours at 50 rpm. After the polymerization, the slurry was cooled and dilute hydrochloric acid was added thereto to remove the dispersing agent, followed by washing and drying to obtain a cyan toner. As a result of measurement by using a Coulter counter, the cyan toner particles showed a number-basis particle size variation coefficient of 27% and SF-1 of 104. The sectional microphotograph of the toner particles was schematically as shown in FIG. 2, having a core-shell structure wherein the ester wax B (low-softening compound) was encapsulated within the outer shell A. To the toner particles, 2 wt. % of hydrophobic titanium oxide fine powder was externally added to prepare a cyan toner excellent in fluidity (agglomeratability of 18%).

6 wt. parts of the cyan toner and 94 wt. parts of acrylic resin-coated magnetic spherical ferrite carrier (Dw=35 μm, σs=50 emu/g) were blended to form a two-component type developer. The developer was charged in a cyan developing device comprising the above-prepared developing sleeve and used for 5000 sheets of a continuous copying test including the magnetic brush development by using a remodeled full-color copying machine ("CLC500") equipped with an OPC photosensitive drum. As a result, the transfer ratio was 95%, and it was possible to stably obtain clear and well-fixed images free from image density change or irregularity. No melt-sticking of toner components was observed on the developing sleeve surface.

Yellow toner particles were prepared in the same manner as above for the cyan toner formation except that C.I. Pigment Yellow 17 was used as a yellow colorant. The resultant yellow toner particles showed an SF-1 of 110, a weight-average particle size (Dw) of 6.7 μm and a number-basis variation coefficient of 30%. The yellow toner particles were blended with 20 wt. % of hydrophobic titanium oxide fine powder to prepare a yellow toner with an agglomeratability of 23. Similarly as the cyan toner, the yellow toner was formulated into a two-component type yellow developer, which was then charged into a yellow developing device.

Magenta toner particles were prepared in the same manner as above for the cyan toner formation except that C.I. Pigment Red 202 was used as a magenta colorant. The resultant magenta toner particles showed an SF-1 of 104, a weight-average particle size (Dw) of 7.0 μpm and a number-basis variation coefficient of 29%. The magenta toner particles were blended with 20 wt. % of hydrophobic titanium oxide fine powder to prepare a magenta toner with an agglomeratability of 20%. Similarly as the cyan toner, the magenta toner was formulated into a two-component type magenta developer, which was then charged into a magenta developing device.

Black toner particles were prepared in the same manner as above for the cyan toner formation except that graft carbon black was used as a black colorant. The resultant black toner particles showed an SF-1 of 106, a weight-average particle size (Dw) of 7.2 μm and a number-basis variation coefficient of 30%. The black toner particles were blended with 20 wt. of hydrophobic titanium oxide fine powder to prepare a black toner with an agglomeratability of 15. Similarly as the cyan toner, the black toner was formulated into a two-component type black developer, which was then charged into a black developing device.

The cyan, yellow, magenta and black developing devices were used to form a full-color toner image on a first surface of a sheet of plain paper, followed by hot-pressure roller fixation to form a full-color fixed image, and then a full-color fixed image was formed and fixed on a second surface of the plain paper sheet, whereby full-color fixed images were formed on both surfaces of the plain paper. As the ester wax contained in the toners well functioned, no offset was observed.

EXAMPLE 2

A toner was prepared and formulated into a two-component type developer, which was then used for image formation in the same image forming apparatus as in Example 1.

| | |
|---|---|
| Styrene-n-butyl acrylate copolymer | 200 wt. parts |
| C.I. Pigment Blue 15:3 | 14 wt. parts |
| Saturated polyester resin (terephthalic acid/propylene oxide modified bisphenol A; acid value = 15, peak molecular weight = $6 \times 10^3$) | 10 wt. parts |
| Dialkylsalicylic acid metal compound | 2 wt. parts |
| Ester wax compound (1) | 15 wt. parts |

The above ingredients were sufficiently melt-kneaded through an extruder and then pulverized by impingement using a jet stream, followed by pneumatic classification utilizing the Coanda effect to obtain cyan toner particles having a weight-average particle size (Dw) of 8.2 μm and a number-basis variation coefficient (AVN) of 32%. To the cyan toner particles, commercially available calcium phosphate fine powder was externally added, and the resultant mixture powder was dispersed in water by means of a homomixer. Then, the water temperature was gradually raised and the heat-treatment for sphering was performed at 80° C. for 3 hours. Then, dilute hydrochloric acid was added to the system to sufficiently remove the calcium phosphate on the toner particle surfaces by dissolution. Then, the toner particles were washed and dried to recover cyan toner particles, which showed a spherical shape and a shape factor SF-1 of 121 as a result of an electron microscopic observation. The toner particles showed Dw=7.8 μm and $A_{VN}$=29%.

Similarly as in Example 1, the cyan toner particles were mixed with a similar external additive to prepare a cyan toner (agglomeratability of 25%) and blended with a similar carrier to prepare a two-component-type developer, which was then evaluated in the same manner as in Example 1. At the initial stage and at the point of 5000 sheets in the continuous copying test, no melt-sticking of toner components or localization of developer on the developer-carrying member was observed. As a result, no image irregularity or ground fog was observed. However, the transfer ratio from the OPC photosensitive drum to the transfer receiving medium was 90%.

EXAMPLE 3

A developing sleeve identical to the one prepared and used in Example 1 was uniformly coated with a phenolic resin solution in methyl ethyl ketone containing carbon black and graphite powder dispersed therein, followed by drying and curing to prepare a resin-coated developing sleeve, which showed Ra=1.7 μm, Sm=28.0 μm and Ra/Sm=0.061.

The resin-coated developer sleeve was evaluated for image formation together with the two-component type cyan developer of Example 1. At the initial stage and at the time of 5000 sheets in the continuous copying test, no melt-sticking of toner components or localization of developer on the resin-coated developing sleeve was observed. As a result, no image irregularity or ground fog was observed.

COMPARATIVE EXAMPLE 1

A developing sleeve of SUS with surface roughness factors of Ra=0.1 μm, Sm=29.6 μm and Ra/Sm=0.0034 was used for a continuous image formation test by using a two-component type developer prepared in the same manner as in Example 1. From a 300 th-sheet of the test, the developer failed to be sufficiently applied onto the developing sleeve, thereby providing a low image density of 1.0 and an image density difference of 0.2 in the lateral direction due to localization of the developer.

COMPARATIVE EXAMPLE 2

A developing sleeve of SUS with surface roughness factors of Ra=0.2 μm, Sm=85.0 μm and Ra/Sm=0.0024 was used for a continuous image formation test by using a two-component type developer prepared in the same manner as in Example 1. From the outset of the test, the developer failed to be sufficiently applied onto the developing sleeve, thereby providing a low image density of 1.1 and an image density difference of 0.32 in the lateral direction due to localization of the developer.

COMPARATIVE EXAMPLE 3

A developing sleeve of SUS with surface roughness factors of Ra=5.5 μm, Sm=12.0 μm and Ra/Sm=0.458 was used for a continuous image formation test by using a two-component type developer prepared in the same manner as in Example 1. From a 1500 th-sheet of the test, melt-sticking of toner components onto the developing sleeve, whereby the developer began to be insufficiently applied onto the developing sleeve, thereby providing images with density irregularities. As a result, the image density was initially 1.6 but gradually lowered to 0.7 at the time of 1500 sheets. As for the image quality, the images were accompanied with particulate appearance particularly at a halftone part and lacked a gradational characteristic.

COMPARATIVE EXAMPLE 4

A developing sleeve of SUS with surface roughness factors of Ra=5.5 μm, Sm=9.0 μm and Ra/Sm=0.61 was used for a continuous image formation test by using a two-component type developer prepared in the same manner as in Example 1. From a 2300 th-sheet of the test, the developer failed to be sufficiently applied onto the developing sleeve, thereby providing a low image density of 1.10 and an image density difference of 0.15 in the lateral direction due to localization of the developer.

COMPARATIVE EXAMPLE 5

A toner was prepared by the pulverization process in the following manner.

| | |
|---|---|
| Styrene-n-butyl acrylate copolymer | 200 wt. parts |
| C.I. Pigment Blue 15:3 | 14 wt. parts |
| Saturated polyester resin (terephthalic acid/propylene oxide modified bisphenol A; acid value = 15, peak molecular weight = $6 \times 10^3$) | 10 wt. parts |
| Dialkylsalicylic acid metal compound | 2 wt. parts |
| Ester wax compound (1) | 34 wt. parts |

The above ingredients were sufficiently melt-kneaded through an extruder, coarsely crushed and then pulverized by impingement against an impinging plate using a jet stream, followed by pneumatic classification utilizing the Coanda effect to obtain cyan toner particles having Dw=8.3 μm, $A_{VN}$=37% and SF-1=133. On the impinging plate, melt-sticking of toner components was observed.

The cyan toner particles were mixed with 2 wt. % of hydrophobic titanium oxide fine powder externally added thereto to prepare a cyan toner (agglomeratability=68%), which was then formulated into a two-component type developer in the same manner as in Example 1.

The two-component type developer was evaluated by image formation in the same manner as in Example 1, whereby the transfer ratio from the photosensitive drum to the plain paper was as low as 78%.

In a 500 sheets of continuous copying test, the toner melt-sticking onto the developing sleeve surface began to be observed from ca. 300 sheets. As a result, the developer could not be uniformly applied onto the developing sleeve to result in images accompanied with density irregularities. The toner of this Comparative Example showed a low agglomeratability of 68% (compared with 18% of the developer of Example 1). Because of the low fluidity, the image density of 1.02 at the initial stage was lowered down to 0.75 at the time of 500 sheets. The resultant images were accompanied with particulate appearance particularly at halftone parts and lacked a gradation characteristic compared with those obtained in Example 1.

COMPARATIVE EXAMPLE 6

A toner was prepared by the pulverization process in the same manner as in Comparative Example 5 from the following ingredients.

| | |
|---|---|
| Styrene-n-butyl acrylate copolymer | 200 wt. parts |
| C.I. Pigment Blue 15:3 | 14 wt. parts |
| Saturated polyester resin (terephthalic acid/propylene oxide modified bisphenol A; acid value = 15, peak molecular weight = $6 \times 10^3$) | 10 wt. parts |
| Dialkylsalicylic acid metal compound | 2 wt. parts |
| Ester wax compound (1) | 6 wt. parts |

The resultant cyan toner particles, showed SF-1=152, Dw=8.5 μm and $A_{VN}$=36%. The cyan toner particles were externally mixed with 2.0 wt. % of hydrophobic titanium oxide fine powder prepare a cyan toner (agglomeratability=35%), which was then formulated into a two-component type developer and then charged into a cyan developing device.

Yellow toner particles were prepared in the same manner as above for the cyan toner formation except that C.I. Pigment Yellow 17 was used as a yellow colorant. The resultant yellow toner particles showed an SF-1=155, Dw=8.7 μm and $A_{VN}$=39%. The yellow toner particles were blended with 20 wt. % of hydrophobic titanium oxide fine powder to prepare a yellow toner with an agglomeratability of 40%. Similarly as the cyan toner, the yellow toner was formulated into a two-component type yellow developer, which was then charged into a yellow developing device.

Magenta toner particles were prepared in the same manner as above for the cyan toner formation except that C.I. Pigment Red 202 was used as a magenta colorant. The resultant magenta toner particles showed SF-1=153, Dw=8.8 μm and $A_{VN}$=37%. The magenta toner particles were blended with 20 wt. % of hydrophobic titanium oxide fine powder to prepare a magenta toner with an agglomeratability of 36%. Similarly as the cyan toner, the magenta toner was formulated into a two-component type magenta developer, which was then charged into a magenta developing device.

Black toner particles were prepared in the same manner as above for the cyan toner formation except that graft carbon black was used as a black colorant. The resultant black toner particles showed SF-1=154, Dw=9.0 μm and $A_{VN}$=38%. The black toner particles were blended with 20 wt. % of hydrophobic titanium oxide fine powder to prepare a black toner with an agglomeratability of 35%. Similarly as the cyan toner, the black toner was formulated into a two-component type black developer, which was then charged into a black developing device.

The cyan, yellow, magenta and black developing devices were used to form a full-color toner image on both surfaces of a transfer-receiving material, whereas a high-temperature offset was liable to occur than in Example 1.

What is claimed is:

1. An image forming method comprising:

(a) conveying a developer carried on a developer-carrying member to a developing region, wherein the developer comprises a non-magnetic toner having a weight-average particle size of 4–8 μm and a number-basis particle size variation coefficient of at most 35%, and the non-magnetic toner comprises toner particles containing 5–30 wt. % of a low-softening point compound and having a shape factor SF-1 of 100–130; the developer-carrying member having a developer-carrying surface satisfying the conditions of:

$$0.2\ \mu m \leqq Ra \leqq 5.0\ \mu m$$

$$10\ \mu m \leqq Sm \leqq 80\ \mu m,$$

and $$0.05\ \mu m \leqq Ra/Sm \leqq 0.5\ \mu m$$

wherein Ra denotes a center line-average roughness and Sm denote an average spacing between unevenness;

(b) developing an electrostatic latent image formed on an electrostatic latent image-bearing member with the developer in the developing region to form a toner image on the electrostatic image-bearing member;

(c) transferring the toner image to a transfer-receiving material; and (d) fixing the toner image on the transfer-receiving material.

2. The image forming method according to claim 1, wherein the developer-carrying member is provided with a plurality of grooves on the surface thereof extending in a direction perpendicular to a direction of conveying the developer.

3. The image forming method according to claim 1, wherein the developer-carrying member is provided with a plurality of equally spaced grooves on the surface thereof extending in a direction perpendicular to a direction of conveying the developer.

4. The image forming method according to claim 1, wherein said developer is a two-component type developer comprising the toner and a magnetic carrier.

5. The image forming method according to claim 4, wherein the magnetic carrier having a weight-average particle size of 10–40 μm.

6. The image forming method according to claim 5, wherein the magnetic carrier has a saturation magnetization (σs) of 30–70 emu/g under an applied magnetic field of 3000 oersted.

7. The image forming method according to claim 1, wherein said developer-carrying member comprises a developing sleeve enclosing a magnetic field generating means and having a cylindrical shape with a diameter of 12–30 mm.

8. The image forming method according to claim 7, wherein said developing sleeve has a cylindrical shape with a diameter of 15–25 mm.

9. The image forming method according to claim 1, wherein said toner has an agglomeratability of at most 30%.

10. The image forming method according to claim 9, wherein said toner has an agglomeratability of 3–25%.

11. The image forming method according to claim 1, wherein said low-softening point compound comprises ester wax.

12. The image forming method according to claim 11, wherein said ester wax has a hardness of 0.5–5.0.

13. The image forming method according to claim 1, including conducting step (c) by transferring the toner image to the transfer-receiving material via an intermediate transfer member.

* * * * *

UNITED STATES PATENT AND TRADEMARK OFFICE

CERTIFICATE OF CORRECTION

PATENT NO. : 5,729,805

DATED : March 17, 1998

INVENTOR(S): TATSUHIKO CHIBA ET AL.

It is certified that error appears in the above-identified patent and that said Letters Patent is hereby corrected as shown below:

COLUMN 2

Line 44, "provide" should read --to provide--.

COLUMN 4

Line 48, "5 30" should read --5-30--;
Line 58, "satisfy" should read --satisfies--.

COLUMN 5

Line 38, "actor." should read --factor.--.

COLUMN 6

Line 66, "larger" should read --is larger--.

COLUMN 8

Line 8, "(I) - (Iv):" should read --(i)-(IV):--.

COLUMN 9

Line 67, "sphearing" should read --spheroiding--.

COLUMN 10

Line 51, "shering" should read --shearing--.

UNITED STATES PATENT AND TRADEMARK OFFICE

CERTIFICATE OF CORRECTION

PATENT NO. : 5,729,805

DATED : March 17, 1998

INVENTOR(S): TATSUHIKO CHIBA ET AL.

It is certified that error appears in the above-identified patent and that said Letters Patent is hereby corrected as shown below:

COLUMN 13

Line 31, "an" should read --and--;
Line 64, "naphtoic" should read --naphthoic--.

COLUMN 16

Line 19, "calculate" should read --calculated--.

COLUMN 17

Line 6, "with" should be deleted;
Line 10, "become" should read --becomes--;
Line 61, "ta" should read --at--.

COLUMN 18

Line 49, "("LC500", " should read --("CLC500,"--.

COLUMN 20

Line 10, "20wt." should read --20wt.%--;
Line 23, "well-functioned," should read --functioned well,--;
Line 47, "(AVN)" should read —$(A_{vn})$—

UNITED STATES PATENT AND TRADEMARK OFFICE

CERTIFICATE OF CORRECTION

PATENT NO. : 5,729,805

DATED : March 17, 1998

INVENTOR(S): TATSUHIKO CHIBA ET AL.

It is certified that error appears in the above-identified patent and that said Letters Patent is hereby corrected as shown below:

COLUMN 24

Line 27, "having" should read --has--.

Signed and Sealed this

First Day of December, 1998

*Attest:*

*Attesting Officer*

BRUCE LEHMAN

*Commissioner of Patents and Trademarks*